US007255546B1

(12) United States Patent
Del Rio

(10) Patent No.: US 7,255,546 B1
(45) Date of Patent: Aug. 14, 2007

(54) SPINDLE FOR A VANE MOTOR

(75) Inventor: Eddy H. Del Rio, Royal Palm Beach, FL (US)

(73) Assignee: The Anspach Effort, Inc., Palm Beach Gardens, FL (US)

( * ) Notice: Subject to any disclaimer, the term of this patent is extended or adjusted under 35 U.S.C. 154(b) by 0 days.

(21) Appl. No.: 11/093,589

(22) Filed: Mar. 30, 2005

Related U.S. Application Data

(60) Provisional application No. 60/567,188, filed on Apr. 30, 2004.

(51) Int. Cl.
*F03C 2/00* (2006.01)
*F04C 18/00* (2006.01)

(52) U.S. Cl. ..... 418/259; 418/268; 418/269; 418/270

(58) Field of Classification Search ..... 418/266–270, 418/259, 77, 78
See application file for complete search history.

(56) References Cited

U.S. PATENT DOCUMENTS 999,753 A * 8/1911 Curtis ..... 418/269
3,162,141 A * 12/1964 Vlachos ..... 418/268
3,171,587 A * 3/1965 Ulrich et al. ..... 418/124
3,221,665 A * 12/1965 Hartmann ..... 418/268
3,469,500 A * 9/1969 Lutz et al. ..... 418/2
3,700,363 A * 10/1972 Sorensen et al. ..... 418/270
3,767,335 A * 10/1973 Kramer et al. ..... 418/259
4,599,058 A * 7/1986 Stone ..... 418/268
5,501,586 A * 3/1996 Edwards ..... 418/264
5,954,141 A * 9/1999 Li et al. ..... 173/93.5

FOREIGN PATENT DOCUMENTS

DE 19756105 A1 * 12/1998 ..... 418/268
JP 55148901 A * 11/1980 ..... 418/268
JP 11351123 A * 12/1999 ..... 418/268

* cited by examiner

*Primary Examiner*—Theresa Trieu
(74) *Attorney, Agent, or Firm*—Norman Friedland

(57) ABSTRACT

The spindle of a vane motor is designed to enhance the power, speed and torque by undercutting the spindle adjacent to the vanes on the power stroke side to increase the working area of the vanes and by adding slots intermediate the vane formed in said spindle and each slot has a working face for accepting pressurized air during the power stroke. The slots are located out of coincidence with the rotating axis of the spindle and the vanes include a contoured bottom edge fitted into the slots so as to enhance its ability to be retracted in opposition to centrifugal force created by the rotating cylinder.

6 Claims, 2 Drawing Sheets

SPINDLE FOR A VANE MOTOR

This application claims the benefits under 35 U.S.C. § 119(e) of the U.S. provisional patent application 60/567,188 filed on Apr. 30, 2004

RELATED APPLICATIONS

This invention relates to the pneumatic motor entitled SURGICAL PNEUMATIC MOTOR and was invented by myself and co-inventor Douglas Perry and identified as application Ser. No. 11/082,124 recently filed as a non-provisional application and is incorporated herein by reference and is commonly assigned to The Anspach Effort, Inc.

FEDERALLY SPONSORED RESEARCH OR DEVELOPMENT

Not applicable

TECHNICAL FIELD

This invention relates to spindles of a pneumatic vane motor of the type that converts fluid pressure to rotational movement and particularly to the design of the spindle and vanes that result in an increase in the RPM and torque of the vane motor.

BACKGROUND OF THE INVENTION

Rotary machines typically utilize vane motors that are pneumatically powered to cause rotation of the output shaft. As is well known these machines comprise a cylinder, sometimes referred to as a casing and an eccentrically mounted spindle in the cylinder, sometimes referred to as a rotor. The cylinder is stationary and through apertures in the cylinder lead pressurized air to impinge on the reciprocating vanes mounted in slots formed in the spindle to cause the spindle to rotate and exhaust the spent air through additional holes formed in the cylinder. The outer edge of the vanes is in contact with or in close proximity to the inner surface of the cylinder during the power stroke of the vane motor and during the exhaust portion of the stroke the spindle recedes from the inner surface of the cylinder. Heretofore the vanes have been a rectangularly shaped planar member with a top and bottom straight edge where the bottom edge fits into slots formed in the spindle and the top straight edge bears against or is in close proximity to the circular surface of the cylinder. During the power stroke the vanes are in position adjacent to the inlet apertures. The slots in the vanes for supporting the vanes typically are oriented to be in coincidence with the center line of spindle. Obviously, the rotational speed is dictated by the power stroke, the pressure of the pressurized air and the area of the vane/spindle where the air impinges thereon.

I have found that the vane motor can be enhanced by undercutting the slots supporting the vane, by providing slots at judicious locations formed in the spindle, and/or by orienting the axial vane slots so that they are displaced from the centerline of the spindle. Adding slots to the spindle adds additional working area and undercutting the slots supporting the reciprocating vanes increases the working area of the vanes. In other words, a vane motor designed with the above features provide for a given pressure of the pressurized air, a vane motor that will rotate faster and produce more torque. Or, otherwise, the vane motor can be made smaller while producing the same rpm and torque that would be produced by a larger sized vane motor.

SUMMARY OF THE INVENTION

An object of this invention is to design the spindle of a vane motor so that the spindle includes discrete slots and undercuts that increase the working area of the vanes and add working area to the spindle.

A still further object of this invention is to offset the slots supporting the vanes so that they are not in coincidence with the rotating axis of the spindle that ease the ability of the vanes to retreat in the slot in opposition to centrifugal force generated by the rotating spindle.

A feature of this invention is to design the bottom edge of the vane that fits into the spindle slot to be curved in the shape of a crescent.

A still further feature of this invention is to orient the face of the slots and undercut to be in direct line with the pressurized air during the power stroke and to locate the slots in the spindle around its periphery between adjacent vanes.

The foregoing and other features of the present invention will become more apparent from the following description and accompanying drawings.

BRIEF DESCRIPTION OF THE DRAWINGS

These figures merely serve to further clarify and illustrate the present invention and are not intended to limit the scope thereof.

DETAILED DESCRIPTION OF THE INVENTION

While this invention is being described in its preferred embodiment as the spindle that are utilized of a vane motor utilized in a surgical pneumatic drills, as one skilled in the art will appreciate this improved spindle can be utilized for any type of pneumatic motor that is employed in any type of pneumatic surgical drill as well as any other pneumatic rotary machines that may or may not be utilized in the medical industry.

Figure 1:
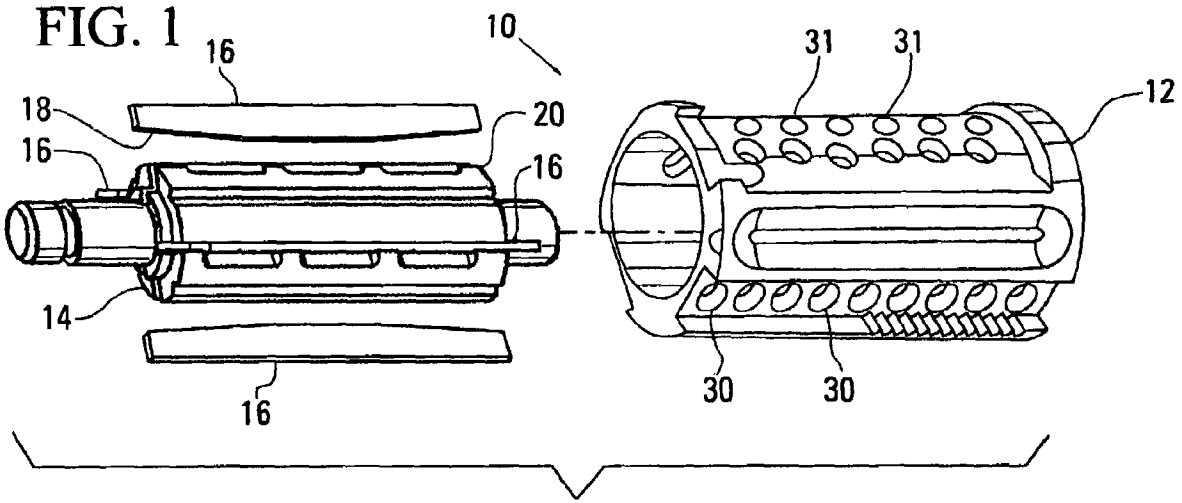
FIG. 1 is an exploded view in perspective illustrating the inventive spindle of a vane motor.

Referring to all of the Figs. and as best seen in FIG. 1 which is an exploded view of a preferred vane motor which is generally illustrated by reference numeral 10 and which comprises the cylinder 12, the spindle 14, and the vanes 16. In the preferred embodiment four (4) vanes are equally and circumferentially spaced around the periphery of the spindle. Obviously, more or less number of vanes can be employed without departing from the scope of this invention. Two important consideration are taken into account in connection with these vanes. The first is the shape of the vanes. In accordance with this invention each vane 16 is contoured so that the bottom edge 18 that fits into its respective slot 20 of spindle 14 is essentially crescent shape and the top edge 19 is straight. The second is that the direction of the slot indicated by line A of each of the slots 20 are oriented so that they are spaced from the center axis B of the spindle 14 or in other words the direction of the slots are not in coincident with the center line of the spindle. The vanes 16 reciprocate in the slots 20 as the vanes precede from the power cycle to the exhaust cycle. By orienting the slots 20 so that they are out of coincidence with the center line of the spindle 14, the vanes 16 sliding in the slots 20 of spindle 14 enhance the vanes ability to retract into the slot 20 in opposition to the centrifugal force created by the rotational movement of the spindle with a consequential reduction in friction and an increase in the life of the motor.

Figure 2:
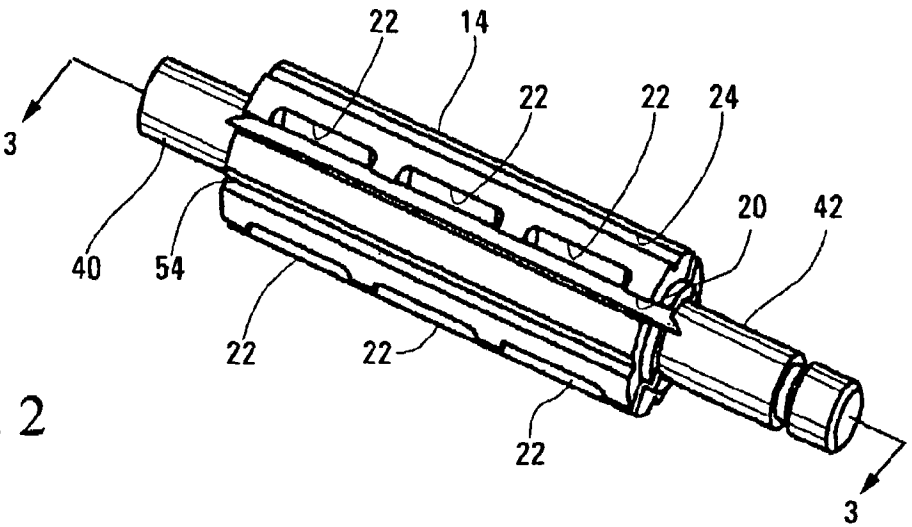
FIG. 2 is an enlarged perspective view of the spindle of this invention.
Figure 3:
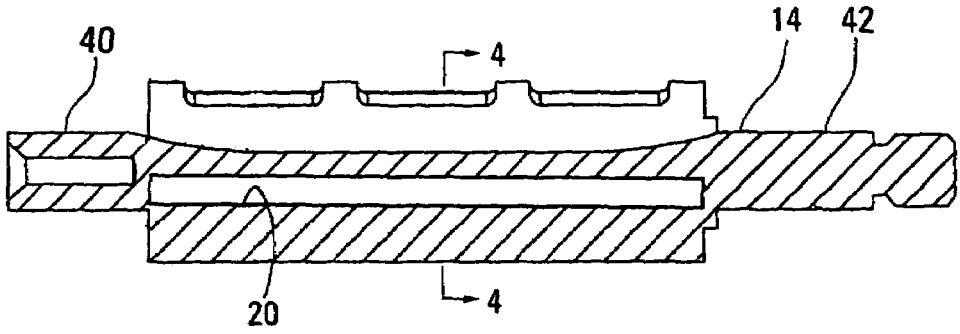
FIG. 3 is a sectional view taken along the lines 3-3 of FIG. 2.
Figure 4:
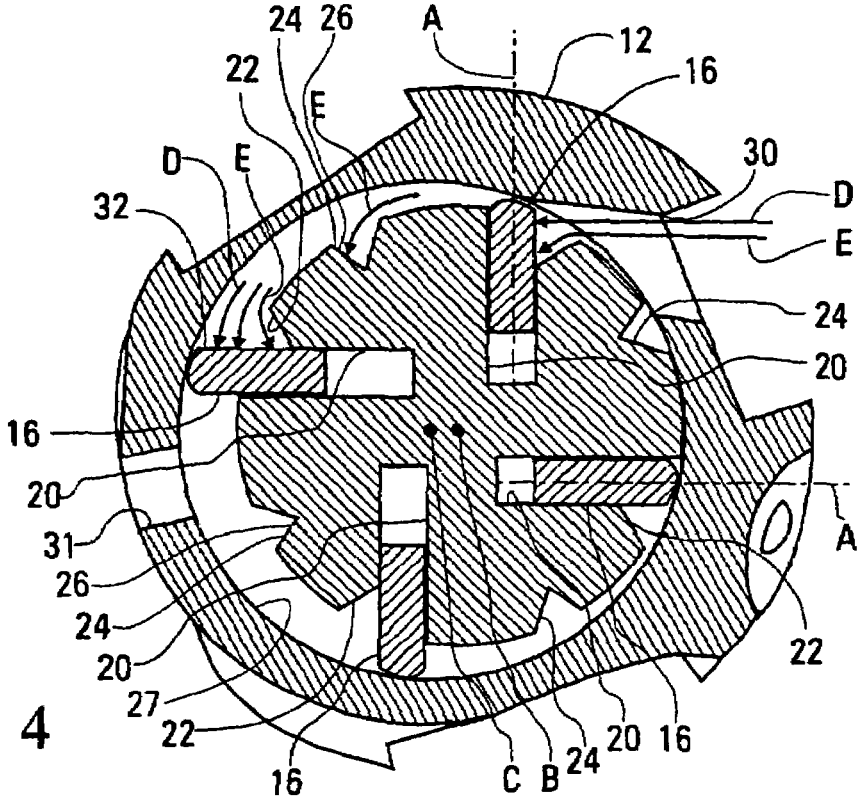
FIG. 4 is a sectional view taken along the lines 4-4 of FIG. 3 including a cross section of the assembly with the cylinder.

Also, in accordance with this invention the spindle speed and torque is enhanced by the following two innovations. First, vane 16 on the spindle 14 is designed to have increased vane working surface for augmenting the power of the motor. This aspect of the invention is best seen by referring to FIGS. 2, 3 and 4 which are views of the spindle per se aid the section of the assembled unit, namely, spindle 14, vanes 16 and cylinder 12. As can be seen in these Figs. spindle 14 is undercut adjacent to the upstream end (power side) which serve to define the axially spaced slots 22. In this instance the spindle 14 includes three axially spaced slots 22. The number of axially spaced slots is dictated by the particular application and size of the spindle and do not limit the scope of this invention. Obviously, the slots 22 are on the power side of the vane 16 where the air impinges thereon and hence, the working area of the vanes is increased. As noted from all the Figures the slots 22 are equally spaced in the axial direction and are all of the same dimension such that they define a uniform and constant area so that the force of air acting on the face of said vane is uniform at each spaced recess and hence, provides a uniform and constant force on the vanes. Second, and in accordance with this invention, a plurality of circumferentially spaced judiciously shaped slots 24 are formed on the outer periphery of spindle 14 oriented between vanes 14. The number and exact location of slots 24, like the undercuts 22 are predicated on the size of the vane motor and other considerations. In the preferred embodiment slots 24 are equally spaced between vanes 14 and each slot includes a power face 26 that is oriented so that when in the power stroke the face 26 is perpendicular or nearly so relative to the flow of the pressurized air. And has been shown in FIG. 2 extend axially the extent of the spindle.

Hence, the orientation and shape of the slots 22 and 24 serve to both increase the working area of vanes 16 adjacent to the slot 22 which maximizes the impingement area of the vanes 16 and in addition adds working area to the spindle. The overall effect is to enhance the power created by the vane motor.

In operation of the vane motor, pressurized air is introduce to the spindle to the inlet opening 30 formed in cylinder 12. As shown by the arrows D and E when the vanes are in the power stroke, the pressurized air impinges on the power face 32 of the vanes 16 above and below the outer surface of the spindle. In addition the pressurized air impinges on the face 26 formed in slot 24. Obviously, the center line B of spindle 14 is eccentric to the center line C of the central bore 27 of the cylinder 12 such that the spindle 14 is closer to the inner diameter or surface of cylinder 12 during the power stroke and is further from the inner diameter of cylinder 12 during the exhaust portion of the stroke. The spent air is exhausted via the outlet port 31. As is apparent from the foregoing the arrows D represent the flow of pressurized air in heretofore known vane motors and the arrows E represent the flow of pressurized air in the modified spindle 14 of this invention. The consequence of this invention is that the spindle is designed to have an increased area of surface contact by the pressurized air. This impingement serves to enhance the energy that is exerted by the spindle such that both the rotational speed in revolutions per minute (RPM) and the torque created by the vane motor is increased for a given pressure of pressurized air. Hence, for a given RPM and desired torque, the vane motor dimensions can be decreased over heretofore known vane motors, decreasing the size of the motor while obtaining satisfactory results.

In a surgical tool application, spindle 14 carries at either end the stub shafts 40 and 42 that are rotary supported by bearings (not shown) and one of these shafts is utilized to drive an output shaft. The output shaft serves to power the surgical tool that is used by surgeons for performing certain medical procedures.

Although this invention has been shown and described with respect to detailed embodiments thereof, it will be appreciated and understood by those skilled in the art that various changes in form and detail thereof may be made without departing from the spirit and scope of the disclosed invention.

The invention claimed is:

1. A spindle for a vane motor having a power stroke and an exhaust stroke and being eccentrically mounted in a cylinder for unitary rotary motion, said spindle being eccentrically mounted relative to said cylinder and including a plurality of vanes having a working face and being motivated by impinging pressurized air admitted thereto on said working face through apertures in the cylinder during said power stroke and said cylinder including a circumferentially outer periphery, said vanes mounted in complementary axial slots formed in said spindle for reciprocal motion, said vane having a top edge and a bottom edge, said top edge being straight and said bottom edge being contoured and said bottom edge being disposed in said complementary slots, means for increasing the area of said working face of said plurality of vanes by undercutting said spindle adjacent to said slot where said pressurized air impinges on said vanes and said undercuts includes three axially spaced undercuts wherein the space between said axially spaced undercuts extend to said outer periphery wherein said undercutting defines a plurality of axially spaced undercuts and being in the same direction of said slot.

2. A spindle for a vane motor as claimed in claim 1 including slots formed in said spindle between adjacent vanes and having a working face for receiving pressurized air so as to enhance the power output of said spindle.

3. A spindle for a vane motor as claimed in claim 1 wherein said undercutting defines a plurality of axially spaced undercuts and being in the direction of said slot.

4. Means for enhancing the power output of a vane motor including a spindle and a cylinder, said spindle being eccentrically mounted in the cylinder for unitary rotary motion, a plurality of vanes having a working face and being motivated by impinging pressurized air admitted thereto on said working face through apertures in the cylinder, said vanes being mounted in complementary axial slots formed in said spindle for reciprocal motion, means for increasing the area of said working face of said plurality of vanes by undercutting said spindle adjacent to said slot where said pressurized air impinges on said vanes, and wherein said undercutting defines three axially spaced undercuts and all of which being in the same direction of said slot.

5. In combination, a vane motor, said vane motor having a power stroke and an exhaust stroke and having a spindle, cylinder and a plurality of vanes, said spindle being eccentrically mounted in said cylinder for unitary rotary motion, each of said plurality of vanes having a working face for motivating said spindle by impinging pressurized air on said working face admitted thereto through apertures formed in said cylinder during said power stroke, each of said vanes mounted in complementary axial slots formed in said spindle for reciprocal motion, each of said vanes having a top edge and a bottom edge, said top edge being straight and said bottom edge being contoured and said bottom edge being disposed in said complementary slots, means for increasing the area of said working face of said plurality of vanes by undercutting said spindle adjacent to said slot where said pressurized air impinges on said vanes, the undercutting of said means defines three axially spaced recesses and said recesses are equally dimensioned to define a uniform and constant area so that the force of air acting on the face of said vane is uniform at each spaced recess, said complementary slots being circumferentially spaced about said spindle, said spindle having a rotating axis, said slots being spaced out of coincidence with said rotating axis, additional slots formed in said spindle having a working face for receiving pressurized air to impinge thereon so as to enhance the power output of said spindle and each of said additional slots being a straight thru cut in said spindle extending from the front face to the rear face of said spindle such that the force acting on the face of said additional slots is uniform.

6. The combination as claimed in claim 5 wherein said additional slots are circumferentially spaced around said cylinder and being spaced intermediate adjacent vanes of said plurality of vanes.

* * * * *